US007862199B2

(12) United States Patent
Ladstätter et al.

(10) Patent No.: US 7,862,199 B2
(45) Date of Patent: Jan. 4, 2011

(54) LUMINAIRE HAVING A FIBEROPTIC ELEMENT AND AT LEAST ONE DIFFUSSOR ARRANGED LATERALLY WITH RESPECT THERTO

(75) Inventors: Gerald Ladstätter, Klaus (AT); Anton Mündle, Satteins (AT)

(73) Assignee: Zumtobel Lighting GmbH (AT)

( * ) Notice: Subject to any disclaimer, the term of this patent is extended or adjusted under 35 U.S.C. 154(b) by 16 days.

(21) Appl. No.: 12/162,809

(22) PCT Filed: Jan. 31, 2007

(86) PCT No.: PCT/EP2007/000823

§ 371 (c)(1),
(2), (4) Date: Nov. 20, 2008

(87) PCT Pub. No.: WO2007/088037

PCT Pub. Date: Aug. 9, 2007

(65) Prior Publication Data

US 2009/0103315 A1 Apr. 23, 2009

(30) Foreign Application Priority Data

Feb. 1, 2006 (DE) ..... 10 2006 004 579
Apr. 28, 2006 (DE) ..... 10 2006 019 924

(51) Int. Cl.
*F21V 1/00* (2006.01)

(52) U.S. Cl. ..... 362/217.02; 362/223; 362/355; 362/147

(58) Field of Classification Search ..... 362/147, 362/223–225, 217.02–217.09, 217.1, 217.11–217.17, 362/260, 240–247, 31.01, 328, 339, 355
See application file for complete search history.

(56) References Cited

U.S. PATENT DOCUMENTS 2,244,737 A 6/1941 Stewart
2,602,135 A 7/1952 Nordquist
4,768,140 A * 8/1988 Szpur ..... 362/342

(Continued)

FOREIGN PATENT DOCUMENTS

DE 4443916 5/1996
DE 20104346 6/2001

OTHER PUBLICATIONS

International Search Report PCT/EP2007/000823; Dated Jun. 11, 2007.

*Primary Examiner*—Ismael Negron
*Assistant Examiner*—Julie A Shallenberger
(74) *Attorney, Agent, or Firm*—Cantor Colburn LLP

(57) ABSTRACT

The invention concerns a luminaire having a housing, which at the emission side of the luminaire has a housing opening, having, situated in the housing, connection means for at least one lamp which define the position thereof in the housing, having a light guiding element which is so positioned that, in the main emission direction, it is located in front of the lamp to be used, and having at least one diffuser arranged at the side neighbouring the light guiding element, which has a shaping projecting beyond the edge of the housing, having a flank rising towards the light guiding element. In order to improve the light guiding and/or light emission of the diffuser, the shaping has further a flank falling towards the light guiding element.

16 Claims, 3 Drawing Sheets

U.S. PATENT DOCUMENTS 5,806,968 A * 9/1998 Tsai ..... 362/225
6,733,154 B1 * 5/2004 Dahlen ..... 362/224
6,746,133 B2 * 6/2004 Loga et al. ..... 362/147
7,229,191 B1 * 6/2007 Plunk et al. ..... 362/223

* cited by examiner

LUMINAIRE HAVING A FIBEROPTIC ELEMENT AND AT LEAST ONE DIFFUSSOR ARRANGED LATERALLY WITH RESPECT THERTO

TECHNICAL FIELD OF THE INVENTION

The invention concerns a luminaire.

BRIEF SUMMARY OF RELATED ART

A luminaire of this kind is described in DE 44 43 916 C1. In the case of this known luminaire on the emission there are arranged a light guiding element in a middle position and two diffusers on the two sides of the light emission element, which are located in the plane of a housing opening. In accordance with FIG. 4 there are involved substantially flat diffusers in the form of plates which respectively extend with the light guiding element in the plane defined by the housing opening.

In the case of the embodiment in accordance with FIG. 5 of this document there is provided a diffuser on both sides of the light guiding element which diffuser extends from its inner edge region, adjacent to the light guiding element, substantially parallel to the plane defined by the housing opening, extends to the side outwardly and is arched backwardly towards the housing, so that it has a flank rising from the side outer edge towards the light guiding element.

BRIEF SUMMARY OF THE INVENTION

The invention improves light guiding and/or light emission of a diffuser. Further, the luminaire is to have a flat construction.

In the case of the luminaire in accordance with the invention the shaping further has a flank falling towards the light guiding element. The diffuser thus has on both sides a respective flank wherein the rising flank is away from the light guiding element and the falling flank is towards the light guiding element. Through this it is possible, depending on steepness of the flanks, to influence the light guiding or the light emission in the main emission direction or towards the side to which the flanks are in each case facing. Thereby it is possible, in the region of the rising flank, to backlight the edge of the housing and brighten the surroundings of the luminaire, in particular when the rising flank is steep and includes a relatively large angle with the plane of the housing opening, which may be up to about 90°.

It can be provided that the light guiding element is so arranged that a surface of the light guiding element which is turned away from the lamp, is located at least substantially in the plane of the housing opening. In the case of a recessed luminaire it can in particular be brought about in this way that the luminaire's has overall a very flat appearance and nevertheless can brighten surrounding wall or ceiling regions. It can be provided, for example, that the luminaire is conceived as a recessed ceiling light and a plane correspondingly is defined with reference to the luminaire in which a surrounding ceiling region is provided for the installed luminaire and the surface of the light guiding element is arranged at least substantially in this plane.

It is possible in the region of the falling flank to influence the light guiding or light emission, depending on steepness of the flank, in the main emission direction and/or to the side turned towards the light guiding element. In particular when the falling flank includes a relatively large angle with the plane of the housing opening, which may be e.g. up to about 80° or up to about 90°, it is possible selectively to emit light inwardly at the side or to couple in light of the light guiding element, which is to the benefit of the light emission in the region of the rising flank.

The effectiveness of the light emission directed to the side outwardly or to the side inwardly or the light guiding can be adapted to desired parameters with the choice of the steepness of the respective flank. With increasing steepness the proportion of the light which is emitted outwardly to the side or is emitted inwardly to the side or is guided through is greater.

Within the scope of the invention the shaping may have the form of a roof directed to the side outwardly or to the side inwardly, the roof surfaces of which are flat or convexly or concavely rounded. Thereby there can be realised a narrow or common roof ridge which may be angular or rounded and may be arranged e.g. in the edge region turned towards the light guiding element or turned away.

Within the scope of the invention the steepness, starting from side inner and/or side outer flank edge, may also be progressive or degressive.

To ensure a flat construction of the luminaire it is advantageous to arrange the side outer and the side inner edge of the diffuser in a plane which is arranged parallel to the plane of the housing opening or lies in the plane of the housing opening.

To improve the light emission, it is advantageous to arrange a reflector in the housing which preferably has the form of an arched tunnel. In order thereby to ensure a manner of construction as flat as possible it is advantageous to constitute the angle included in each case between the reflector side walls and the plane of the housing as an acute angle, in particular an angle of up to 30°.

Features which further improve the light emission or the light guiding in particular whilst ensuring a flat construction and in addition ensure a simple and economical production are contained in the dependent claims.

BRIEF DESCRIPTION OF THE DRAWINGS

Below, advantageous configurations of the invention will be explained in more detail with reference to drawings and preferred embodiments. There is shown.

DETAILED DESCRIPTION OF THE INVENTION

Figure 1:
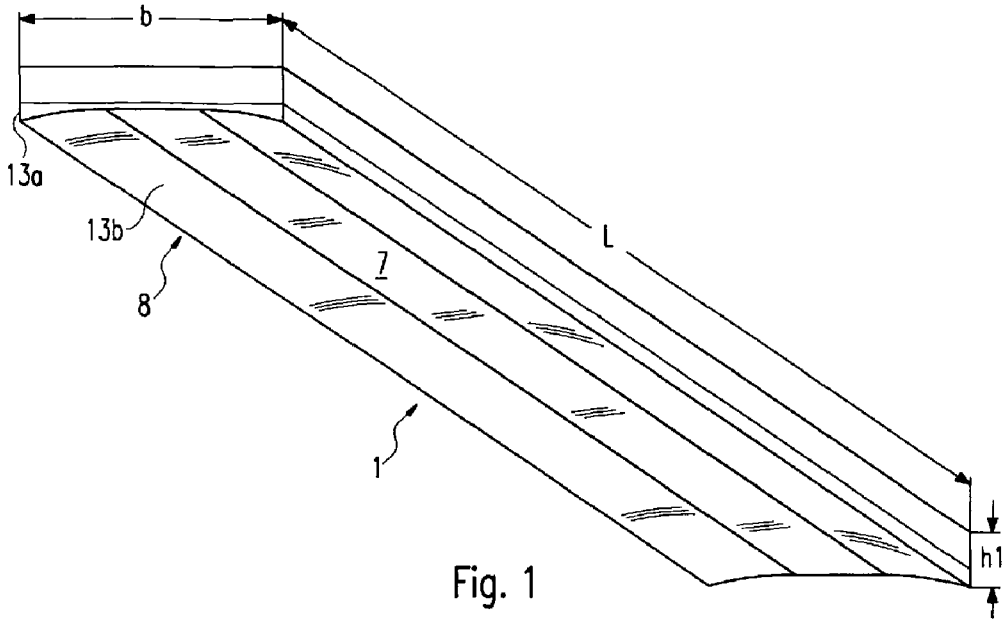
FIG. 1 a luminaire in accordance with the invention in perspective side view, view from below and end view.

The main parts of the luminaire, designated by 1 as a whole, which is preferably of an elongate form, are a tub-shaped housing 2 having a housing opening 2*a* which is bounded by the free edge 2*b* of the housing 2, a reflector 3 arranged in the housing and behind the housing opening 2*a*, one or a plurality of, e.g. two, connection means 4, arranged in the housing 2 beside one another, for one or a plurality of lamps 5, a light guiding element 7 arranged, in the installed condition, before the lamp or lamps 5 in the main emission direction 6 and two diffusers 8 which are arranged on the two sides of the light guiding element mutually oppositely at the sides. However, also only one diffuser 8 may be arranged on one side.

The main emission region B of the luminaire 1 bounded in substance by the housing opening 2*a* and activated by the reflector 3 consists of a middle, functional region B1 determined by the light guiding element 7 and two lateral effect regions B2 determined by the diffusers 8 which depending on configuration of the luminaire may be bounded from each other at the side or transition into one another, or may overlap one another. The tub-shaped housing 2 is preferably a flat housing, the height h1 of which is smaller than about ⅕ of the visible width dimension b of the housing 2 in FIG. 1. The height h1 may approximately amount to ⅕ to 1/10 of the width b and in the case of the embodiment it amounts preferably to approximately to 1/7 to ⅛ of the width b.

The form of the luminaire 1 visible contrary to the main emission direction 6 may be compact, e.g. rectangular or quadratic. In the case of the embodiment the luminaire 1 is of elongate form, i.e., its visible length L in FIG. 1 is a multiple of its width b, e.g. the 2 to 3 times the width b.

Figure 2:
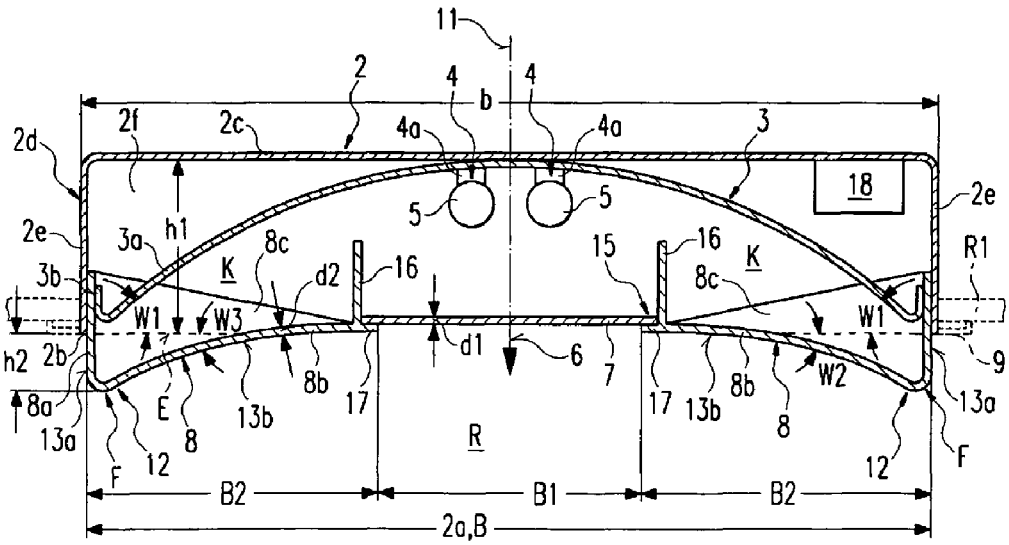
FIG. 2 the section II-II in FIG. 1.

The width dimensions of the effect and functional regions B1, B2 visible in FIG. 2 may be approximately the same or differently sized. In the case of the embodiment the equally large widths of the effect regions B2 are slightly larger than the width of the functional region B1.

The luminaire 1 so far described may be a recessed luminaire, in particular a recessed ceiling luminaire, or a surface mounted luminaire, it can in particular a ceiling surface mounted luminaire or a pendant luminaire, in particular a ceiling pendant luminaire.

The housing 2 has a base wall 2*c* and, standing out from the perimeter thereof, a peripheral wall 2*d* which in the case of a quadrilateral, in particular elongate, form of the luminaire 1 is of four oppositely lying side walls of which—in the case of the embodiment with an elongate form—the mutually oppositely lying longitudinal side walls are designated by 2*e* and the narrow-side side walls are designated by 2*f*.

A recessed luminaire has a perimeter edge flange 9, indicated by broken line, projecting outwardly from the free edge 2*b* of the housing 2, which flange in the installed condition bears on the bearing side of a body receiving the luminaire 1 in an installation opening, e.g. at the underside of a room ceiling R1, which is also illustrated schematically in FIG. 2. The edge flange 9 can be stiffened and stabilized on its free edge by means of an angling.

It can be provided that the free edge 2*b* of the housing 2 and a surface of the light guiding element 7, which is turned away from the lamp 5 or lamps 5, lie at least in substance in a plane. In the installed condition the light guiding element 7 is in this case thus virtually flush with the ceiling. This is indicated in FIG. 2. In this way it can be achieved that the surface of the luminaire 1 which is visible in the installed condition appears very flat.

The reflector 3 is likewise of a flat form and arched upwardly in flat dome. It extends from the one side wall up to the opposite side wall, here between the side walls 2*e*, wherein it may be constituted for its stabilization with, on its lower edges, in each case an upwardly bent or angled edge strip 3*b*, which can serve also in the fastening or support of the reflector 3. The curvature of the reflector 3 visible in FIGS. 2 and 4 may be substantially uniform and formed by a circular arc section. Thereby the reflector 3 may lie with its roof ridge on the base wall 2*c* so that this is approximately a tangent of the circular arc form. The edge-side side wall sections 3*a* of the reflector include an acute angle W1 with the plane E of the housing opening 2*a* which is about 30 to 60°, in particular about 40 to 45°. In the inner roof ridge region of the reflector there are located, e.g. two mechanical and electrical connection means 4 which are arranged beside one another, which are arranged individually or in common on a cheek piece 4*a*, which at one or at the two end regions of the housing 2 facing each other, e.g. project downwardly from the reflector 3 or the base wall 2*c*, or are arranged on the mutually oppositely lying housing walls 2*f*. The at least one lamp 5 is preferably a fluorescent lamp, which is formed in particular in the case of an elongate luminaire 1 by at least one straight-extending tube (fluorescent lamp).

The light guiding element 7 is, in particular in the case of an elongate luminaire 1, longitudinally glare suppressed. There may be involved e.g. a per se known louvre with transverse lamellas or a perforated plate or a diffuser.

The diffusers 8 are preferably like and formed and arranged in mirror image manner with reference to the vertical longitudinal middle plane 11. Only one of the two diffusers 8 therefore need be described.

The light guiding element 7 and/or the diffuser 8 may be formed e.g. in each case by means of a sheet of glass or plastic which couples out diffuse light at their side towards the room. Here there may be involved a plate which has at its inner side or outer side a coupling out structure, which brings about the diffuse coupling out of light on the side towards the room to be illuminated, the structure may e.g. be formed e.g. by tooth-shaped or pyramid-shaped elevations arranged in longitudinal and/or transverse rows, which may be formed on the plate itself or on a transparent foil, which is attached to the relevant broad side of the plate or of the diffuser 8.

The diffuser 8, extending in the associated functional region B2 from the housing edge 2*b* to the light guiding element 7, has a shaping 12 projecting beyond the housing edge 2*b* towards the room R to be illuminated, the height of which projecting beyond the housing edge 2*b* is designated by h2. The actual height of the diffuser 8 is preferably larger than its height h2, but the diffuser 8 extends with this height region into the housing. It has a wall 8*a* directed to the side outwardly which extends into the cavity of the housing 2 and may bear on the inner side of the opposite broad housing wall 2*e*. The shaping 12 extends parallel to the vertical longitudinal middle plane 11, whereby in the case of the present elongate luminaire 1—as already the housing 2, the reflector 3 and the light guiding element 7—it extends profile-shaped in the longitudinal direction. Within the scope of the invention the luminaire 1 may also have a round form. In this case the shaping 12 extends in the circumferential direction of the luminaire 1.

The shaping 12 is bounded by the mutually oppositely lying sides by flanks 13*a*, 13*b*, of which the flank 13*a* extends towards the housing 2 at an exterior of the luminaire 1, and the flank 13*b* extends towards the guiding element 7 at an interior of the luminaire 1. The angle W2 (FIG. 4) of the flank 13*a* and the angle W3 of the flank 13*a* can be formed in a region between zero or a couple of angle degrees and substantially 90°. Thereby the flanks 13*a*, 13*b* can extend straight in vertical cross-section or be constituted concavely or convexly, in particular be rounded concavely or convexly, as the Figures show. In the case of a rounding the angles can also start from 0° as FIG. 2 shows at the inner edge and FIG. 4 shows at the outer edge of the diffuser 8.

Seen in cross-section of the luminaire 1 the shaping 12 thus has the form of a roof, which extends parallel to the vertical longitudinal middle plane 11 or in the case of a round luminaire 1 extends in the circumferential direction of the luminaire 1. The roof surfaces formed by the flanks 13*a*, 13*b* of the roof have preferably a common roof ridge F, which extends parallel to the vertical longitudinal middle plane 11 or in the circumferential direction of the luminaire, and may be formed by a roof ridge edge or a convex roof ridge rounding. However, the flanks 13*a*, 13*b* may also transition into one another steplessly in the region of the roof ridge F, as FIG. 8—still to be described—shows.

Through the choice of the degree of steepness of the flanks 13*a*, 13*b*, the light guiding through the diffuser 8 or the light emission of the diffuser 8 can be configured differently and therefore adapted under consideration of particular demands. The smaller is the angle W2 or W3, the larger is the component of the light which is shone into the room R to be illuminated. With increasing angle W2 or W3 the proportion of the light guiding through or light emitted with a direction running transversely to the main emission direction 6 increases. In the region of the flank 13*a*, directed to the side outwardly, with increasing angle W2, the light emission is increasingly suited for the purpose of backlighting the housing edge 2*b* and thus to brighten the surroundings of the luminaire 1. This purpose is in particular achieved when the angle W2 is about 75° to about 90°, as FIG. 2 shows. In the case of this embodiment the angle W3 of the falling flank 13*b* is on average about 5° to about 30°, in particular about 10° to about 15°.

Figure 4:
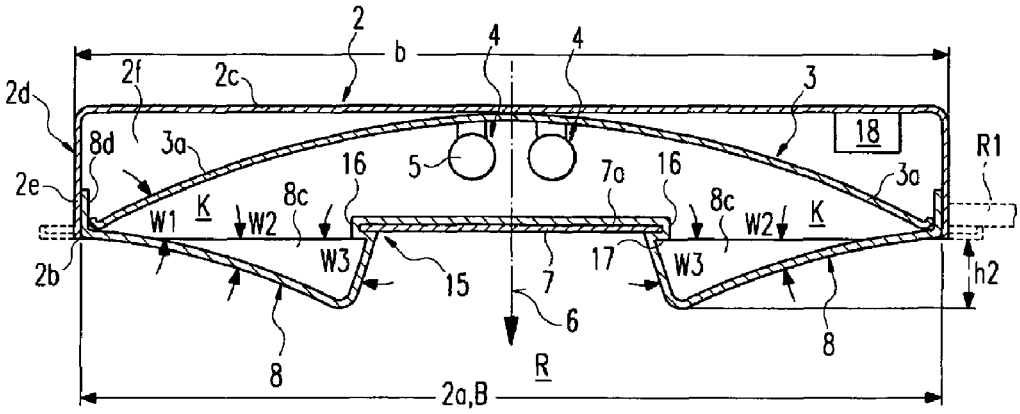
FIG. 4 the section IV-IV in FIG. 3.

In contrast to the embodiment according to FIG. 2 in the case of the embodiment according to FIG. 4 the angle W3 of the flank 13*b* is greater than the angle W2 of the flank of 13*a*. In the case of this configuration the light beams in the region of the flank 13*b* are guided or emitted increasedly transversely of the main emission direction 6 through the associated flank wall 8*b*. Thereby the light can be emitted and/or incident into the region of the flank 13*b*. The incident light issued is beam components of the light emitted by the light guiding element 7. The incident light strengthens the light emission in the region of the wall of the flank 13*a*. Also in the case of this configuration the angle W3 of the flank 13*b* may be up to about 90°. The graphical representation shows an angle W3 of about 60° to about 85°, in particular about 70° to about 80°.

As already in the case of the light guiding element 7 also the diffuser 8 can couple out diffuse light at its side towards the room to be illuminated. Thereby the light guiding element 7 and/or the diffuser 8 may be formed by a plate of partially light permeable material, e.g. glass or plastic. In the case of such a configuration the walls of the flanks 13*a*, 13*b* consist of a plate formed corresponding to the flank form. In the case of an elongate luminaire 1, end walls 8*c* may be arranged at the ends of the diffuser 8, the upper edge of which extends in each case from the upper edge of the side outer wall 8*a* to the inner edge of the side inner wall 8*b*, as FIG. 2 shows. In the case of this configuration has the diffuser 8 a hollow box form.

The thickness d1, d2 of the plate-like light guiding element 7 or the plate-like diffuser 8 may be e.g. about 3 to 10 mm, in particular about 5 to 7 mm.

In the case of the embodiment according to FIG. 4 the end wall 8*c* there is formed corresponding to the form of the shaping 12, wherein the upper edge of the end wall 8*c* may e.g. extend from the upper edge of the falling flank 13*b* e.g. straight as far as the outer edge of the flank 13*a*.

Figure 3:
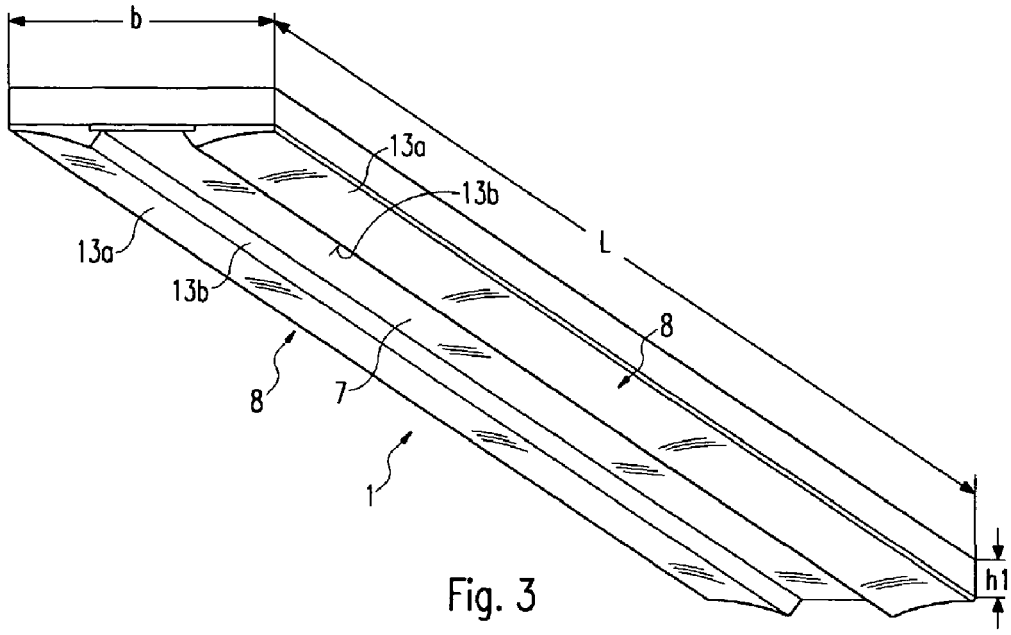
FIG. 3 a luminaire in accordance with the invention in perspective side view, view from below and end view. in modified configuration.

In the case of the embodiment according to FIGS. 3 and 4 the lateral edges of the reflector 3 can simply and advantageously be supported in the throat of the wall 8*a* of the flank 13*a*.

The diffuser 8 oppositely lying in mirror image manner with respect to the vertical longitudinal middle plane 11 is formed and arranged in corresponding mirror image manner so that a special description of the oppositely lying diffuser 8 is not needed.

The light guiding element 7 is preferably held in a plug fitting into which it can be inserted from inside (FIG. 2) or outwardly from an end (FIG. 4). In the case of the embodiment according to FIG. 2 there are arranged in the region of the inner edges of the diffusers upwardly projecting webs 16 formed on in one piece, which extend e.g. approximately up to the middle spacing region between the diffuser 8 and the reflector 3.

The webs 16 may, however, be dimensioned lower, e.g. only to form the plug fitting 15, which is formed on each side by the associated web 16 and an edge web 17 engaging below the light guiding element 7.

In one of the in cross-section triangular free spaces between the reflector 3 the housing walls 2*c*, 2*e*, 2*f* lying opposite thereto there can be advantageously arranged and fastened an operating device 18 for the electrical supply, e.g. on the inner side of the base wall 2*c*.

In the case of the embodiments in accordance with FIGS. 1 to 4 the light guiding element 7 may be carried by the neighbouring located diffusers 8.

Within the scope of the invention it is also possible to fasten the light guiding element 7 and/or the diffusers 8 so to one another that they form a pre-fabricatable component part. Thereby the light guiding element 7 and the diffusers 8 may e.g. be constituted in one-piece. E.g. the inner edges of the diffusers 8 or the webs 16 may be connected by a connection plate 7*a* (FIG. 4), which forms the light guiding element 7 or covers the light guiding element 7 inserted into side plug fitting slots as a light permeable plate.

The embodiments in accordance with FIGS. 5 to 10 show particular features of the configuration of the walls 8*a*, 8*b* of the flanks 13*a*, 13*b*, and this in configurations independent of each other so that the variants may be present individually or in combination.

Figure 5:
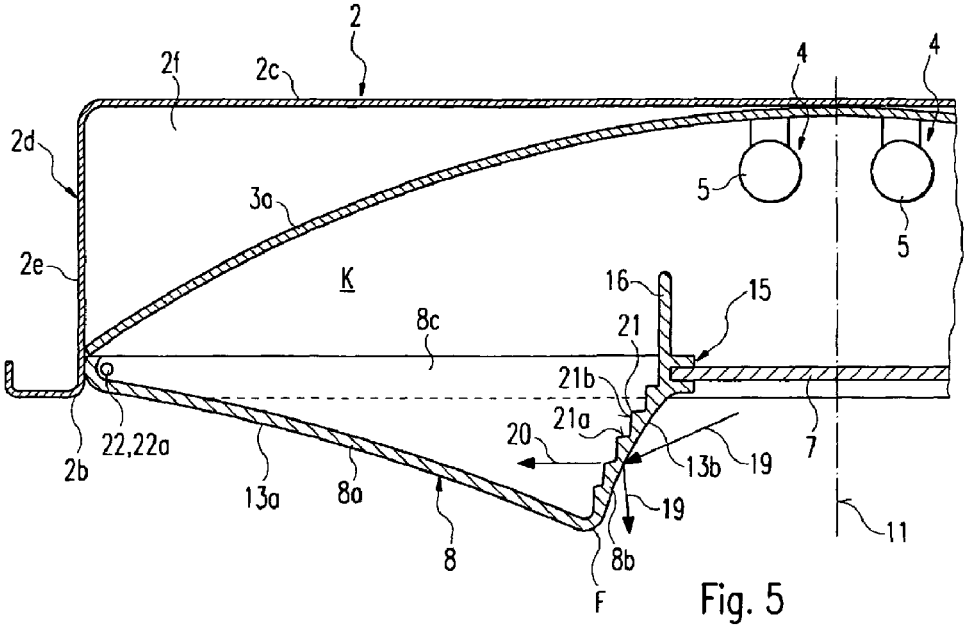
FIG. 5 a left half of the luminaire in cross-section in further modified configuration.
Figure 6:
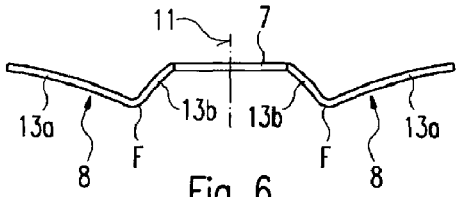
FIG. 6 an emission side part of the luminaire in cross-section and in further modified configuration.

One variation consists in accordance with FIG. 5 e.g. in that the flank 13*b*, in contrast to the configuration according to FIG. 4, does not extend straight but is rounded concavely.

In accordance with another variation the external surface of the flank 13*b* may be constituted as reflection surface 19 so that light shone from the light guiding element 7 against the region of reflection surface 19 is reflected into the room R, as FIG. 5 shows.

In accordance with another variant the wall of the flank of 13*b* may be so constituted so that it at least partially couples in light incident, in accordance with the arrow 20, from the light guiding element 7 and/or the opposite flank 13*b*, which is radiated into light chamber K bounded between the wall 8*a* or the rising flank 13*a* and the oppositely lying reflector 3, and directly or after reflection at the reflector is emitted in the region of the rising flank 13*a*, so that the light emission thereof is strengthened.

In order to improve the light coupling and/or decoupling in the region of the wall of the flank 13*b* it is advantageous preferably to arrange on the wall 8*b* light guiding webs 21 running in the longitudinal direction of the luminaire 1, preferably to form them on in one-piece. In the case of the embodiment the light guiding webs 21 are arranged on the inner side of the wall 8*b* and e.g. formed by surfaces 21*a*, 21*b* extending substantially parallel to the main emission opening and transversely thereto, preferably substantially parallel to the plane of the housing edges 2*b*, which preferably bound triangular cross-sections of the light guiding webs 21.

In accordance with a further variant one diffuser 8 or the associated component part or both diffusers 8 may be in each case connected, in the region of their side outer edges, pivotably around joint axes 22*a* extending parallel to these edges, with the opposite housing wall, e.g. 2*f*, and thus be mounted pivotably upwardly and downwardly. This may be realised e.g. by means of joints 22 arranged in the end regions of the diffuser 8 between the diffuser 9 and the neighbouring side wall.

For holding the diffuser or diffusers 8 concerned or the component part there are present non-illustrated holder elements in the upwardly pivoted functional disposition, which is not illustrated for simplification reasons.

As mentioned already, the flanks 13*a*, 13*b* may have different forms. The embodiment in accordance with FIG. 7 differs from the embodiment in accordance with FIG. 2 e.g. in that the flank 13*a* on the one hand is rounded convexly and on the other hand includes a smaller mean angle W2 which e.g. may be about 75° to about 85°.

Figure 8:
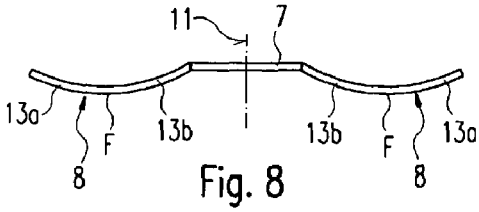
FIG. 8 an emission side part of the luminaire in cross-section and in further modified configuration.

In the case of the embodiment according to FIG. 8 both flanks 13*a*, 13*b* are rounded convexly, in particular rounded in an arc of a circle, wherein they have the form of a common arc, which may be a circular arc.

Figure 9:
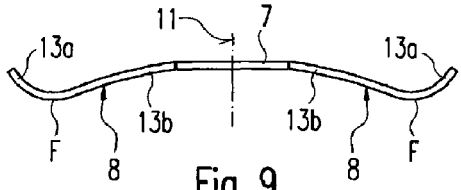
FIG. 9 an emission side part of the luminaire in cross-section and in further modified configuration.
Figure 7:
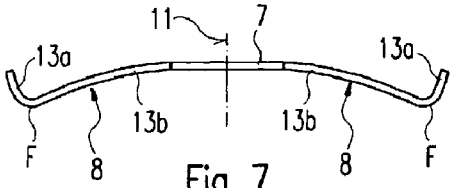
FIG. 7 an emission side part of the luminaire in cross-section and in further modified configuration.

FIG. 9 shows a flank form in the case of which the falling flank 13*b* overall or at least in the region of the roof ridge F extends in substance straight or slightly arched and tangentially transitions into a convex, e.g. circle arc curved rising flank 13*a*.

Figure 10:
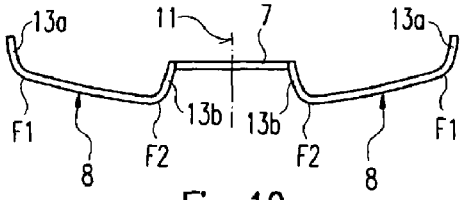
FIG. 10 an emission side part of the luminaire in cross-section and in further modified configuration.

In the case of the embodiment according to FIG. 10 both the flank 13*a* and also the flank 13*b* are formed with a relatively great steepness wherein the angles W2 and W3 are in each case greater than about 60°. Thereby the angle W3 may correspond to the configuration in accordance with FIGS. 4 and 5. The angle W2 may e.g. be about 90° or be slightly smaller, e.g. about 80°, in particular about 85° to about 90°. In the case of this configuration the edge regions of the flank 13*a* and the flank 13*b*, in each case with their edges towards the room R to be illuminated, form a roof ridge F1, F2 between which a third flank 13*c* extends, which may extend straight or convexly curved, and include an angle W4, closed towards the vertical longitudinal middle plane 11, with the plane of the housing opening 2*a*, which may be about 15°, in particular about 5° to about 10°. In the case of an inclined arrangement of the third flank 13*c* the roof ridges F1, F2 are in different height positions.

In the case of all embodiments the side outer and the side inner edges or 9 the edges of the flanks 13*a*, 13*b* away from the room to be illuminated may be arranged in one or in different height planes.

The invention claimed is:

1. Luminaire comprising:

a housing with an emission edge terminating at a housing opening at an end side of the luminaire, connection means for at least one lamp arranged in the housing, the connection means defining the position of the at least one lamp in the housing, a light guiding member, arranged beneath the at least one lamp with respect to a main emission direction, at least one diffuser, arranged at least partially within the housing at a side adjacent the light guiding member, the at least one diffuser having a projecting portion that at least partially extends through the housing opening beyond the emission edge of the housing, and a flank extending in a direction of the housing, wherein, the projecting portion having a further flank extending in a direction of the light guiding member.

2. Luminaire according to claim 1, wherein, the flank includes with a plane of the housing opening an angle open to the emission side greater than 45°.

3. Luminaire according to claim 2, wherein, the angle included between the plane of the housing opening and the flanks is larger than about 75° to 80°.

4. Luminaire according to claim 1, wherein, the further flank includes with the plane of the housing opening an acute angle open to the emission side which is up to about 90°.

5. Luminaire according to claim 1, wherein, at least one of the flank and the further flank has or have surfaces which are flat or rounded concavely or convexly.

6. Luminaire according to claim 1, wherein, the flank and the further flank are arranged roof-like and transition into one another in a region of a common roof ridge.

7. Luminaire according to claim 1, wherein, the flank extends from an inner side edge of at least one of the at least one diffuser and the further flank extends towards an inner side edge of the at least one diffuser.

8. Luminaire according to claim 1, wherein, at least one of the light guiding element and the at least one diffuser are of a plate-shaped material.

9. Luminaire according to claim 8, wherein, at an end the at least one diffuser has end walls.

10. Luminaire according to claim 1, wherein, on each of two sides of the light guiding member one of the at least one diffusers is arranged, formed and arranged in mirror-image manner.

11. Luminaire according to claim 1, wherein, the luminaire comprises a flat luminaire.

12. Luminaire in accordance with claim 11, wherein, a height of the housing is approximately a fifth to a tenth of a width of the housing.

13. Luminaire according to claim 1, wherein, a reflector extends between the connection means and the housing.

14. Luminaire according to claim 1, wherein, mutually oppositely lying edge regions of the reflector include with a plane of the housing opening an acute angle, which is about 60° to about 70°.

15. Luminaire according to claim 1, wherein, a surface of the light guiding member, facing away from the at least one lamp, is arranged substantially in the plane of the housing opening.

16. Luminaire according to claim 1, wherein the at least a portion of the projecting portion extends beyond the light guide member in a direction away from the at least one lamp.

* * * * *